US006695460B1

(12) United States Patent
Warne

(10) Patent No.: US 6,695,460 B1
(45) Date of Patent: Feb. 24, 2004

(54) LED CHRISTMAS TREE FOR DRAG RACING STARTING AND TIMING

(75) Inventor: Jason C. Warne, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 0 days.

(21) Appl. No.: 09/952,090

(22) Filed: Sep. 10, 2001

(51) Int. Cl.[7] ..... H21V 21/00; F21S 8/08

(52) U.S. Cl. ..... 362/249; 362/252; 362/414; 340/942; 377/17

(58) Field of Search ..... 362/249, 252, 362/800, 227, 184, 431, 382, 410, 414, 234; 340/942; 116/63 R; 377/17, 24

(56) References Cited

U.S. PATENT DOCUMENTS 4,275,292 A * 6/1981 Corbi ..... 340/942
4,456,383 A * 6/1984 Speckhart et al. ..... 368/9

* cited by examiner

*Primary Examiner*—Sandra O'Shea
*Assistant Examiner*—Bao Truong
(74) *Attorney, Agent, or Firm*—Hugh D. Jaeger

(57) ABSTRACT

LED Christmas tree for drag racing starting and timing having light emitting diode signal lights arranged on an upper display tier and on a lower display tier.

6 Claims, 2 Drawing Sheets

LED CHRISTMAS TREE FOR DRAG RACING STARTING AND TIMING

CROSS REFERENCES TO RELATED APPLICATIONS

None.

BACKGROUND OF THE INVENTION

1. Field of the Invention

The present invention is for a Christmas tree for drag racing starting and timing, and more particularly, refers to a Christmas tree starting device incorporating light emitting diode signaling lights.

2. Description of the Prior Art

Prior art Christmas tree drag racing starting and timing devices utilized incandescent signaling lights for sequenced starting of dragsters. Often problems were encountered with the use of incandescent signaling lights relating to time sensitive issues and also with the reliability of the incandescent signaling lights. Slower to illuminate incandescent signaling lights generally have an effective illumination time no less than 0.016 second which, when compared to an LED effective illumination time of 0.001 second, is comparatively lengthy. Illumination lags often add small but significant increments of time to a contestant's total elapsed time. Filament damage to incandescent signaling lights was also incurred by extremely high decibel exhaust noise emitted by dragsters, with a particularly high rate of failures attributable to jet powered dragsters. Power requirements for incandescent signaling lights is also a consideration for design of a starting and timing device. other delays occur between the timing console and the Christmas tree starting device. Clearly, what is needed is a Christmas tree starting device which overcomes the deficiencies of the prior art devices.

SUMMARY OF THE INVENTION

The general purpose of the present invention is an LED Christmas tree for drag racing starting and timing. According to one or more embodiments of the present invention, there is provided a Christmas tree starting device incorporating light emitting diode (LE) signaling lights, including an upper display tier and a lower display tier where each tier includes individual groups of multiple LEDs arranged as visible LED signal lights for viewing by at least two dragster participants, as well as opposing individual groups of multiple LEDs arranged as visible LED signal lights for viewing by spectators or others. The upper display tier includes rows of pre-staged and staged LED signal lights about its periphery and the lower display tier includes columns having various colored LED signal lights. The rows and columns of LED signal lights are sequenced in order to signal the participants.

According to one embodiment of the present invention, there is provided an LED Christmas tree for drag racing, including upper and lower display tiers each having a plurality of grouped light emitting diode signal lights arranged thereupon in columns or rows for sequenced starting light functions.

One significant aspect and feature of the present invention is an LED Christmas tree for drag racing starting and timing.

Another significant aspect and feature of the present invention is the incorporation of individual groups of multiple LEDs arranged as visible LED signal lights.

Still another significant aspect and feature of the present invention is an improved illumination reaction time provided by the use of quick-to-illuminate LEDs.

Yet another significant aspect and feature of the present invention is an LED signal light which is not affected by high decibel exhaust noise.

A further significant aspect and feature of the present invention is a construction which is economical to operate.

A still further significant aspect and feature of the present invention is improved reliability.

Having thus described embodiments of the present invention, it is the principal object of the present invention to provide an LED Christmas tree for drag racing starting and timing.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
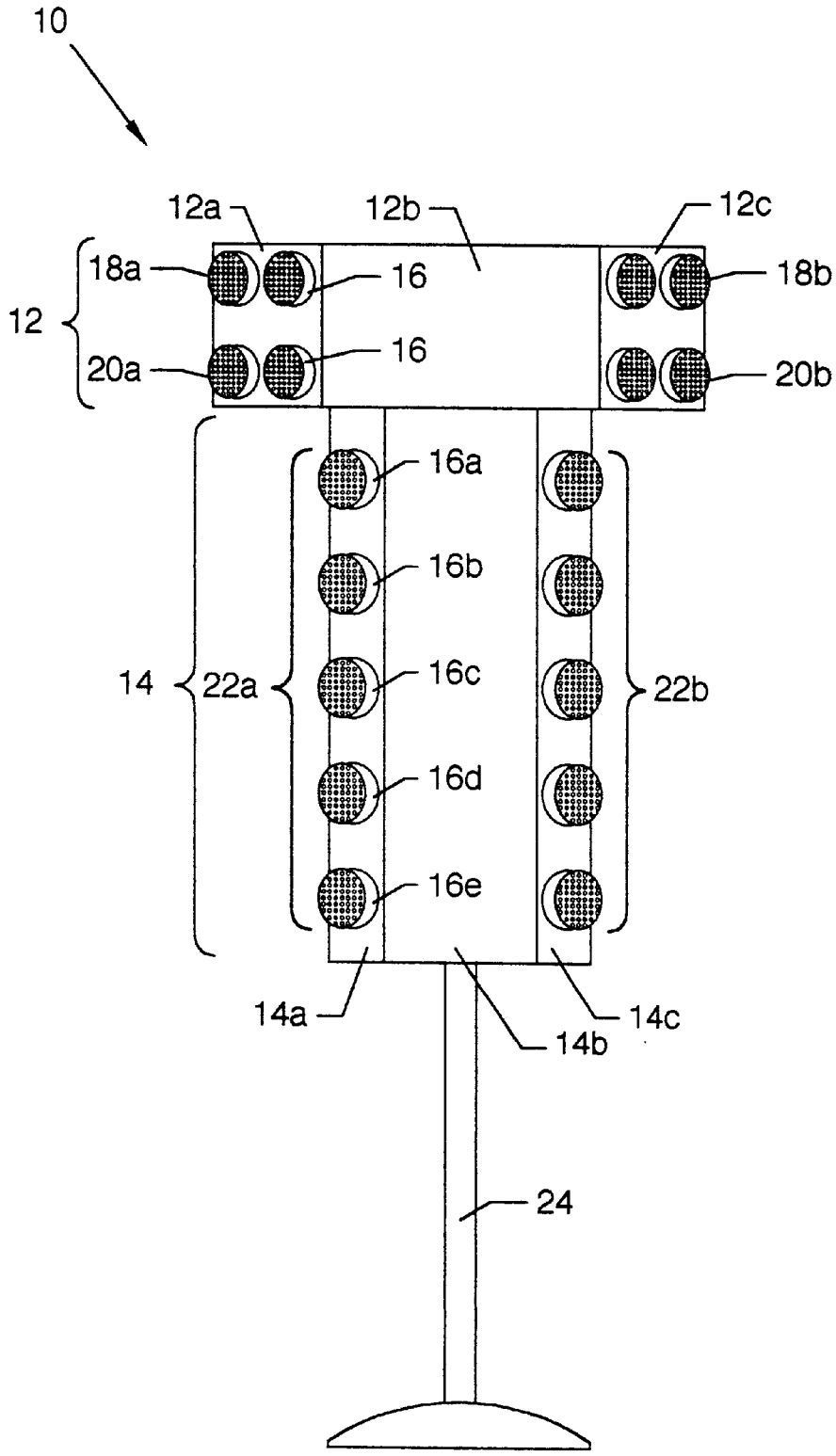
FIG. 1 illustrates a front view of an LED Christmas tree.
Figure 2:
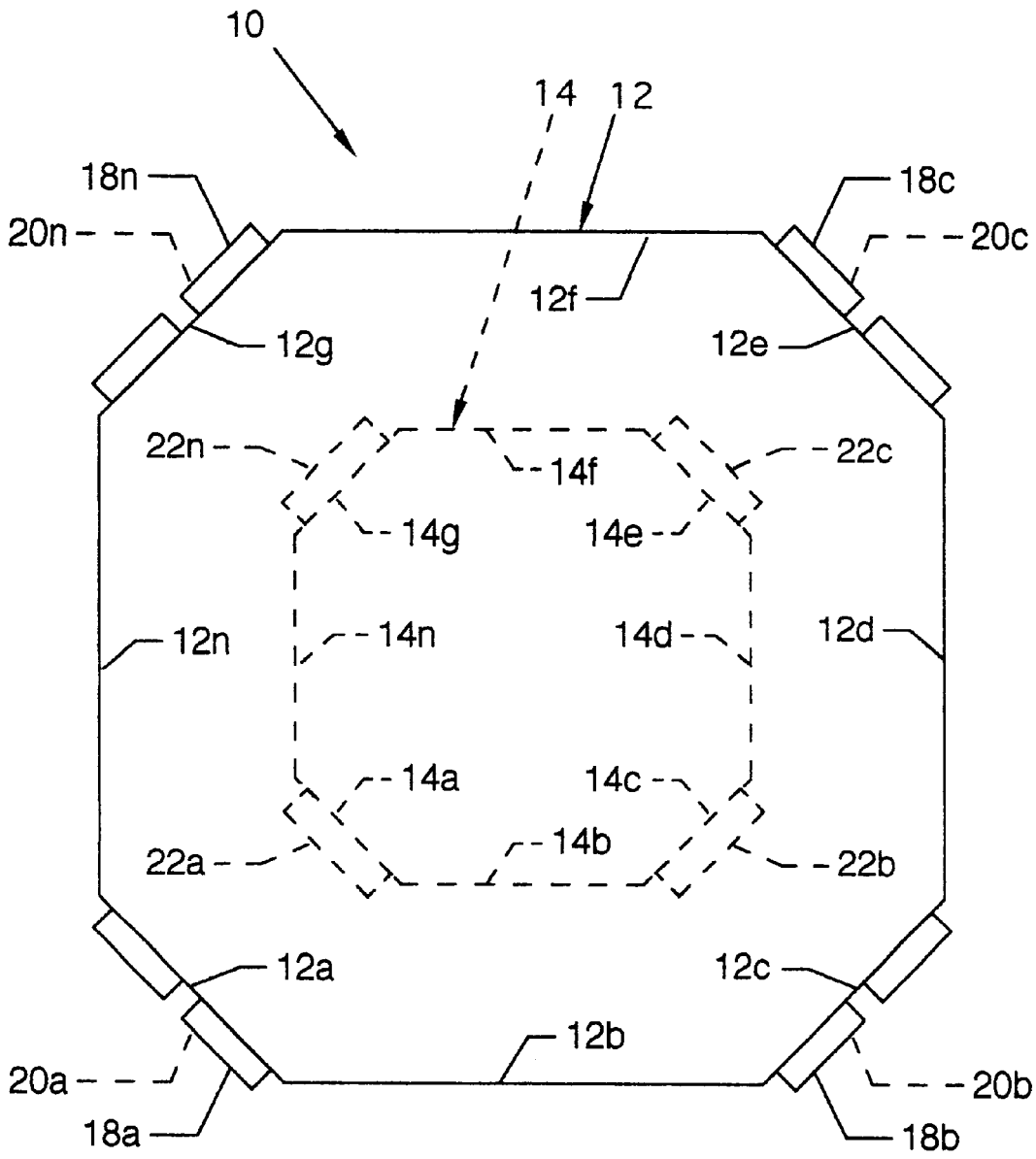
FIG. 2 illustrates a top view of an LED Christmas tree.

FIG. 1 illustrates a front view and FIG. 2 illustrates a top view of an LED Christmas tree 10, the present invention, as used for starting and timing of drag race events. The LED Christmas tree 10 is now described with reference to FIGS. 1 and 2. The LED Christmas tree 10 includes a multiply faced upper display tier 12 aligned to and above a multiply faced lower display tier 14. Groups of closely spaced multiple light emitting diodes (LEDs) arranged as individual visible LED signal lights 16 of appropriate color and size are located along and about the upper display tier 12 and the lower display tier 14, as specified herein. The upper display tier 12 includes a plurality of surfaces 12*a*–12*n*, each adjacently angled with respect to each other, comprising its periphery. Rows 18*a*–18*n* of pre-staged LED signal lights 16 each of amber color are located in horizontal orientation along and about the upper region of the angled surfaces 12*a*, 12*c*, 12*e* and 12*g* of the upper display tier 12. In a similar fashion, rows 20*a*–20*n* of staged LED signal lights 16 each of amber color are located in horizontal orientation along and about the lower region of angled surfaces 12*a*, 12*c*, 12*e* and 12*g* of the upper display tier 12. The lower display tier 14 includes a plurality of surfaces 14*a*–14*n*, each adjacently angled with respect to each other, comprising its periphery. Columns 22*a*–22*n* of pre-staged LED signal lights 16 each of either amber, red or green color are located in vertical orientation along and about the angled surfaces 14*a*, 14*c*, 14*e* and 14*g* of the lower display tier 14. Preferably, the top three LED signal lights 16, herein designated as 16*a*, 16*b*, and 16*c* in descending order, in each of the columns 22*a*–22*n*, but referenced for purposes of clarity and brevity only in column 22*a*, are of amber color. Likewise, and in descending order, LED signal light 16*d* is of red color and LED signal light 16*e* is of green color. The construction of the LED Christmas tree 10 is such that the dragster drivers, as well as the observers and audience members, are afforded views of the LED signal lights 16 of the pre-staged rows 18*a*–18*n* and staged rows 20*a*–20*n* of the upper display tier 12 and of the columns 22*a*–22*n* of the lower display tier 14 mounted respectively on the angled surfaces 12*a*, 12*c*, 12*e*,

12*g*, 14*a*, 14*c*, 14*e* and 14*g*. Appropriate electronic actuating and/or measuring circuitry can be attached to the LED Christmas tree 10 for operation of the LED Christmas tree 10. The upper and lower display tiers 12 and 14 are supported by a support stand 24.

Various modifications can be made to the present invention without departing from the apparent scope hereof.

| PARTS LIST | |
|---|---|
| 10 | LED Christmas tree |
| 12 | upper display tier |
| 12a–n | surfaces |
| 14 | lower display tier |
| 14a–n | surfaces |
| 16 | LED signal light |
| 16a–e | LED signal lights |
| 18a–n | pre-staged rows |
| 20a–n | staged rows |
| 22a–n | columns |
| 24 | stand |

What is claimed is:

1. An LED Christmas tree for drag racing starting and timing, comprising: a stand supporting a lower display tier containing LED signal lights and an upper display tier containing LED signal lights, each of said lower and upper display tiers having a circumference; said LED signal lights of said upper display tier being arranged in horizontal rows extending around the circumference of said upper display, tier with each horizontal row containing at least one four LED signal lights spaced at 90-degree intervals from one another around the circumference of said upper display tier: and said LED signal lights of said lower display tier being arranged in vertical columns spaced about at 90-degree intervals from one another around the circumference of said lower display tier, whereby dragster drivers as well as observers are afforded views of the LED signal lights of both the lower and upper display tiers from any location around the Christmas tree.

2. The LED Christmas tree for drag racing starting and timing as defined in claim 1, wherein the circumference of said upper display tier is greater than the circumference of said lower display tier.

3. the LED Christmas tree for drag racing starting and timing as defined in claim 1, wherein the circumferences of both the lower and upper display tiers are octagonal and are oriented such that the eight surfaces of the octagonal lower display tier are directly beneath and in line with the eight surfaces of the octagonal upper display tier.

4. The LED Christmas tree for drag racing starting and timing as defined in claim 3, wherein the octagonal circumference of said upper display tier is greater than the octagonal circumference of said lower display tier.

5. The LED Christmas tree for drag racing starting and timing as defined in claim 3, wherein said vertical columns of LED signal lights around the octagonal circumference of said octagonal lower display tier are on alternate ones of said eight surfaces of said octagonal lower display tier, and wherein said at least four LED signal lights in the horizontal rows around the octagonal circumference of said octagonal upper display tier are on surfaces of said octagonal upper display tier which are directly above and in line with the surfaces of the octagonal lower display tier upon which said vertical columns of LED signal lights are located.

6. The LED Christmas tree for drag racing starting and timing as defined in claim 1, wherein each of said vertical columns of LED signal lights located directly below a respective one of said at least four LED signal lights in said upper display tier.

* * * * *